United States Patent [19]

Gould et al.

[11] Patent Number: 4,779,559

[45] Date of Patent: Oct. 25, 1988

[54] APPARATUS FOR HIGH PRESSURE IMPACT COATING

[75] Inventors: Kenneth E. Gould, Vicksburg; Eugene A. Hamilton, Mattawan, both of Mich.

[73] Assignee: Peterson American Corporation, Schoolcraft, Mich.

[21] Appl. No.: 901,728

[22] Filed: Aug. 29, 1986

Related U.S. Application Data

[62] Division of Ser. No. 772,441, Sep. 4, 1985, Pat. No. 4,652,468.

[51] Int. Cl.[4] ..... B05B 15/04; B05B 13/06

[52] U.S. Cl. ..... 118/301; 118/317; 118/DIG. 10

[58] Field of Search ..... 118/301, 317, 318, 622, 118/DIG. 10, 408; 427/236, 238, 239

[56] References Cited

U.S. PATENT DOCUMENTS

| | | | |
|---|---|---|---|
| 3,422,795 | 1/1969 | Smoth | 118/317 X |
| 3,811,408 | 5/1974 | Thompson | 118/317 X |
| 3,896,760 | 7/1975 | Dutty | 118/308 |
| 3,974,306 | 8/1976 | Inamura et al. | 427/183 |
| 4,043,295 | 8/1977 | Speck et al. | 118/317 |
| 4,060,868 | 12/1977 | Axvig et al. | 10/72 R |
| 4,327,132 | 4/1982 | Shinno | 427/235 |
| 4,528,938 | 7/1985 | Neville | 118/711 |

*Primary Examiner*—Evan Lawrence

*Attorney, Agent, or Firm*—Miller, Morriss and Pappas

[57] ABSTRACT

A process and apparatus for high pressure impact coating of portions of workpieces such as the threaded openings in fasteners in avoidance of contaminating undesired portions of the workpieces with the coating material. A metered quantity of coating material is charged into a passageway and moved by low pressure air to a chamber ahead of an atomizing nozzle. High pressure air is introduced to the passageway and the coating material is fogged into a chamber defined by the workpiece and tooling. Proliferation and impingement of the cloud on the selected surfaces follows under vented conditions. A constriction in the vent line achieves the necessary delay and sets the system for accomplishing the coating. The machine structure facilitates use of the coating device with a wide range of female threaded fasteners and achieves the process steps while providing for flushing the lines and drying the working structure.

7 Claims, 3 Drawing Sheets

APPARATUS FOR HIGH PRESSURE IMPACT COATING

Figure 1:
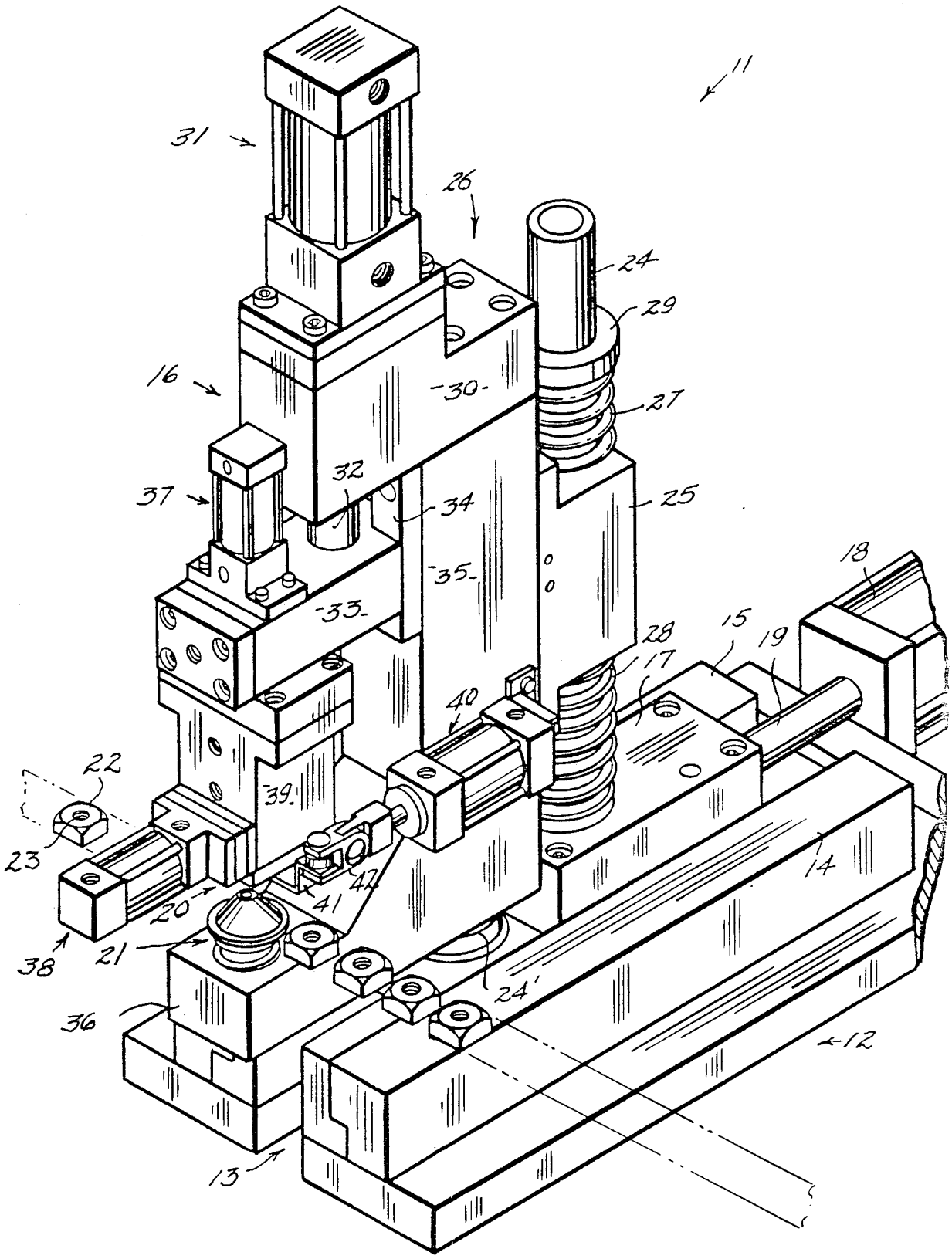

This is a division of co-pending application Ser. No. 772,441, filed on Sept. 4, 1985, now U.S. Pat. No. 4,652,468.

The present invention is directed to an apparatus for the achievement of high pressure impact coating of parts which require precision coating to a specific restricted location, as within threaded cavities, and where it is desired to prevent the coating material from contaminating other portions of the parts. As an example, a typical usage of the apparatus is to apply a fluorinated resin coating, such as "Teflon" (a trademark of E. I. duPont de Nemours & Co.) to the threads of nuts or other fasteners without risking application of the "Teflon" to the exterior of the nuts or fasteners. The presence of the "Teflon" compound is required on the threads but interferes with subsequent plating or surface coating and outer treatment if the thread coating is leaked onto the exterior surfaces. The apparatus of the present invention teaches a structure for the achievement of such a coating on a repetitive part basis to selected surfaces, such as threaded cavities, as found in nuts, for example, and in avoidance of contamination of adjacent and exterior surfaces. The apparatus for practicing the described process meters coating material in a liquid form to a preparation chamber and achieving thereafter a pressure application of the coating material to the surface to be coated through dispersion assist means which fogs the coating into the cavity and exhausts the residue under the influence of a choking of the flow from the cavity while effectively masking the cavity in prevention of the coating from dripping, smearing or splashing on portions of the part where the coating is undesirable. With selected modifications of the fixturing of the apparatus in accord with the configuration of the part to be treated, even external surfaces can be so coated while masking out areas from which the coating needs to be isolated.

BACKGROUND

It is increasingly important to the fastener industry, and especially as it serves the automobile industry, to apply plural and diverse coatings to various portions of a single part. For example, threaded areas may need to be coated with a good bearing material or adhesive material while adjacent areas may require painting or plating for maximum corrosion resistance and the coating materials could interfere with the bonding of the next adjacent surface. This is especially true where the internal surfaces are coated with a material which would act as a resist to subsequent treatment of the exterior of the portion of the resist-reached area and adjacent to the treated area. Present known apparatus for coating the threads for fasteners are slow, manual and generally unsatisfactory.

PRIOR ART STATEMENT

In the prior art, the U.S. Pat. No. 3,974,306 to K. Inamura, et al discloses a system and method for coating the interior surface of pipes using a low pressure application of a dry resin material to the interior of heated pipe sections. Variations of this dry type of application are seen in the U.S. Pat. Nos. 4,060,868 to Axvig and 3,896,760 to R. J. Duffy. In the work of R. Speck, et al in U.S. Pat. No. 4,043,295, a liquid is squirted through a needle valve-like nozzle in a conical spray to the internal threaded end of tubing and a round baffle plate limits the "throw" of the spray to selected portions of the threads. In the U.S. Pat. No. 4,327,132 to K. Shinno, paint (two component) is introduced into a pipe in a gaseous mix and then accelerated by another airstream and blown into and through the pipe. Air delivery continues until the paint is dried. These references fall substantially short of addressing the problem of precision presentation to a selected surface with precision isolation from portions not to be so coated with a liquid material.

Accordingly, the principal object of the present invention is to provide apparatus for applying a precision uniform coating to limited selected surfaces in a part with metered liquid resin material, such as tetrafluoroethylene, while masking and isolating the portions, not to be coated, from contamination by the coating material. The present invention is generally applied to the internal threaded portions of parts, such as fasteners, thereby isolating the remainder of the part, for example, from the impact of the coating. It will be appreciated that the reverse is also intended where the openings are to be isolated and the external portions are to be coated. The invention finds principal application in coating the threads in nuts.

Another object is to devise apparatus for achieving the principal object while providing apparatus for masking, atomization of the liquid coating, and shifting the tooling selectively out of the repetitive pattern to flush or purge the system with solvents and line conditioners as required.

Another object is to assure that the high pressure delivery applied to the atomization of the resin material is choked while being exhausted to assure good dispersion of the coating material and mist impingement of the material on the threads or surfaces requiring coating with proper controlled venting of the air-coating mix.

Still another object is to provide an apparatus and process for coating selected portions of a part while providing structure which withdraws the apparatus from the line of parts to be treated to achieve flushing and stripping of build-up of the coating materials on the closing and sealing surfaces and internal passages.

Other objects, including the achievement of high production with simplicity of parts and overall economical and simplified procedures, will be appreciated as the description proceeds.

GENERAL DESCRIPTION

In general, the invention applies to apparatus for coating surfaces of parts by high pressure application of coating material while preventing the coating material from contacting the parts beyond the selected surfaces for coating by first metering and then injecting a charge of liquid coating material into a holding chamber. The charge is then moved under relatively low pressure from the holding chamber and into a firing chamber. The still liquid charge is then impacted with sudden high pressure air blast which atomizes the material by forcing it through nozzle orifices which are in registry communication with the part to be coated and the atomized material is projected in a diffused and vaporous cloud against the portion of the part to be coated in a vented chamber in which the coated part perimeter forms partial and vented limits for distribution of the coating material and the vented chamber functions to allow exhausting of the coating material, thereby stripping away excess coating material and minimizing the chance of contamination of the part beyond the desired surfaces to be coated. The venting is selected in accord with surface area to be coated, volume of heat chamber, pressure on the atomized coating material, and viscosity of the coating in respect to passage through the selected nozzle. The fine mist is thus uniformly applied to the portion of the part to be coated, for example, threaded openings and then exhausted while the part is shielded from the contact with the coating material. The exhausted portion is reclaimable, the part is indexed away, the cycle is repeated, and in selected treating intervals, the chambers, nozzles and passages are purged with solvent and blown clear. The venting to atmosphere functions as a choke in delay of exhaust. During the atomization, the nozzle is rotated on its axis in relation to the portion of the part to be coated.

From an apparatus point of view, the preferred structure comprises a machine base. The machine base includes ways which permit relative movement between the base and the tooling so as to shift a selected portion of the tooling out of registry with moving parts to be treated and indexed between the aligned tooling which closes on the indexed parts or workpieces consecutively. The tooling group includes a pair of juxtaposed tapered ring-like seals which close and open in axial movement in respect to a part requiring selected coating. The engagement of the tooling and seals, with the part, defines the chamber of exposure of coating material to part and seals to prevent application of coating material to nonselected portions of the part. Together, the seals of the tooling include communicating passages, one seal has a vent or exhaust port through which excess air and coating material passes to atmospheric exhaust and this passage includes an orifice of selected size. The other of the seal elements axially mounts a nozzle which includes a portion which defines a firing chamber and ahead of that is a holding chamber or entry passage. Ports to the passage are valved for selected operation and sequence control admitting a metered supply of coating material, a low pressure air supply and a high pressure air supply. A solvent supply is also connected for selected usage to the principal passage. Parts to be coated or treated are indexed consecutively in a path between the pair of tooling elements and are thus presented for treatment in accord with the aforementioned process requirements. The material of the seals is preferred to be rigid while having some resilience and is resistant to deterioration by contact with the coating material, the solvents, and the part's surfaces. This abrasion resistance is especially important where the tooling closes the seals at the very opposite rim of threaded openings to firmly seat on the ramp or taper of the outermost threaded spirals. The seal portion of the tooling closes on the workpiece in a ring-like manner.

IN THE DRAWINGS

FIG. 1 is a perspective view of the machine of the present invention and practicing the present invention on a repetitively presented (as by conveyor or other known transfer means) group of fasteners (nuts). The workpieces may be individually presented, as shown, or in the form of a "stick" or roll of nuts connected by metal filaments and subsequently separated.

Figure 2:
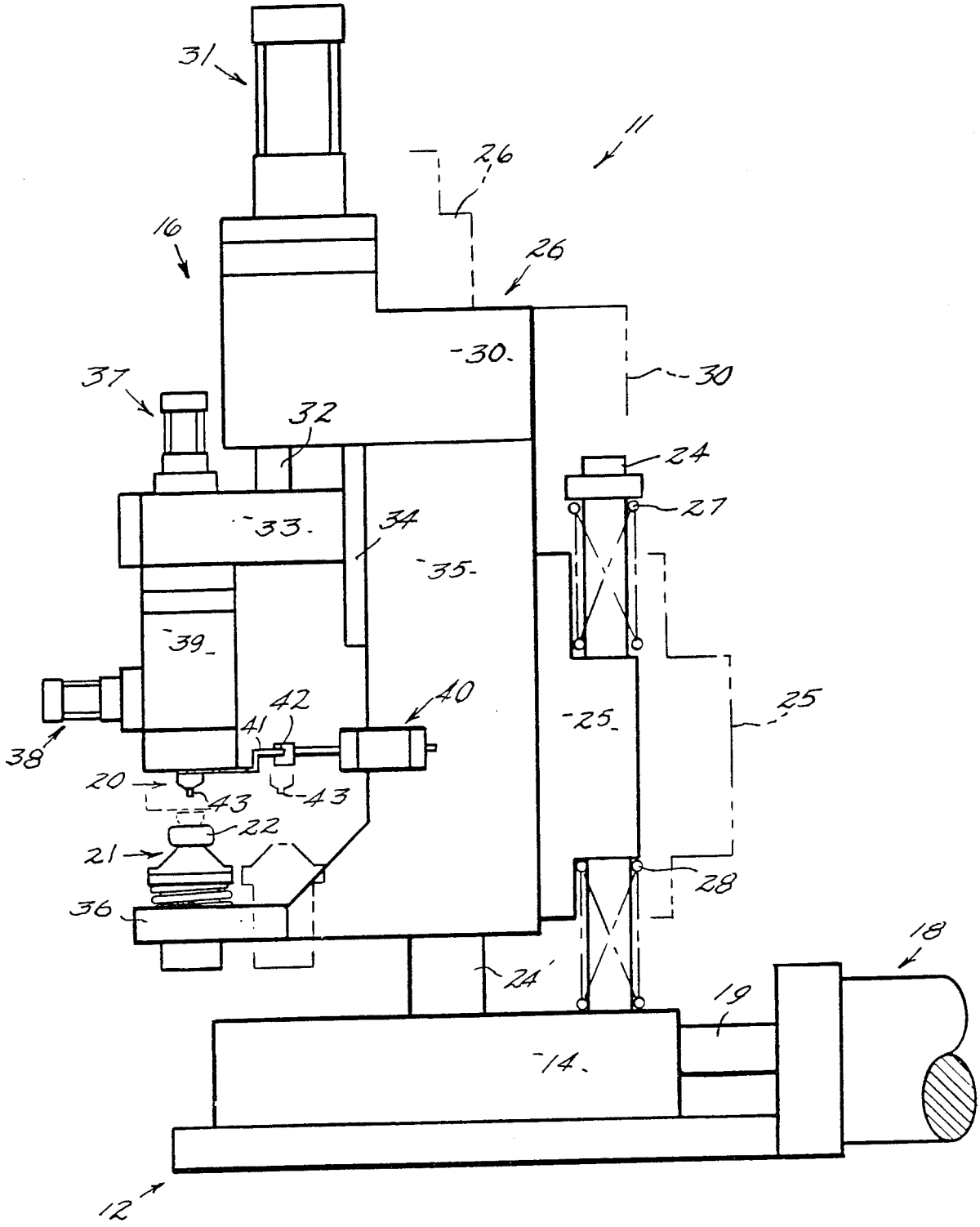

FIG. 2 is a side elevation view of the structure of FIG. 1 and indicating the function of the cylinder actuators in closing and opening the material delivery head upon the part to be coated and masked and closing in general register against an opposed lower mask and vent, with actuation to rotate the diffusion head or nozzle, and apparatus and in shifting the apparatus out of the line of parts delivered for treatment.

Figure 3:
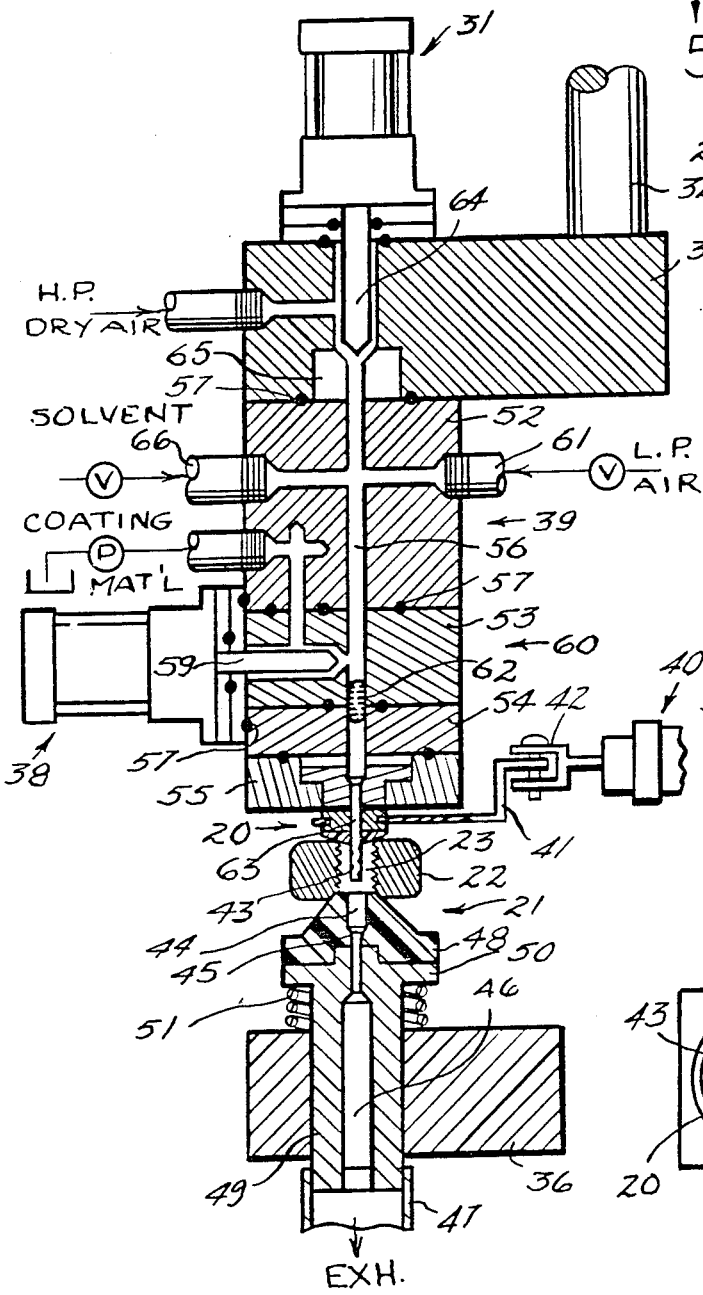

FIG. 3 in a full section view taken through the material delivery head and the lower mask element and machine frame and best indicating the flow of materials.

Figure 4:
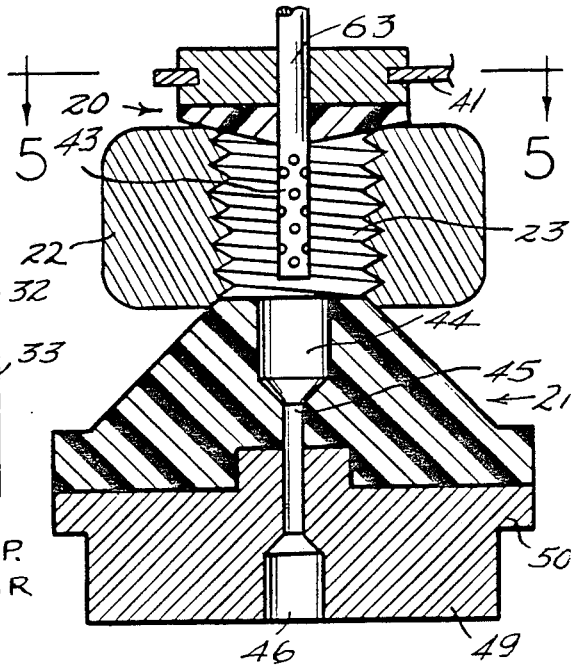
Figure 5:
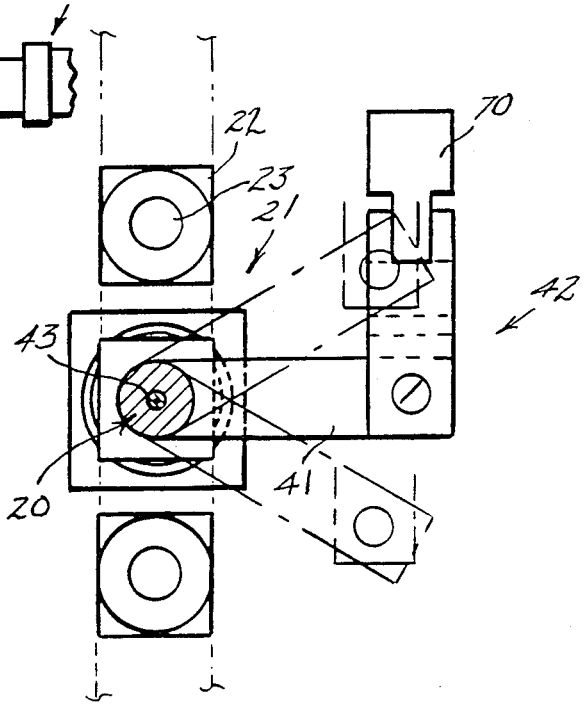

FIG. 4 is an enlarged detail section of the lower tooling and mask element, the upper tooling and mask element and forming a sandwich against the perimeter of the threaded opening in the part to be treated on the line 4—4 of FIG. 5 and indicating the penetration of the atomizing and diffusion nozzle into the threaded cavity of the part and the rotating means therefor. This view also shows the venting of the lower mask element with a choking of the axial orifice therethrough.

FIG. 5 is a top plan section elevation view through the material delivery head and nozzle and taken on the line 5—5 of FIG. 4.

SPECIFIC DESCRIPTION

Referring to the drawing and with first specificity to the FIG. 1, the apparatus 11 of the present invention is shown in its preferred form. The apparatus functions to achieve the process steps of the present invention. The apparatus 11 includes a machine base 12 which includes ways 13 formed by guide strips 14 and 15. The ways 13 establish a path for limited reciprocating movement of the working tool mounting machine head 16 mounted on the travelling block 17. The motor or cylinder 18 is drivably attached to the block 17, as by the piston rod 19, and is firmly secured to the base 12. As shown, the piston 19 has extended the tool mounting machine head 16 to registry of the tooling elements 20 and 21 with the parts 22 and portions to be coated (internal threads 23). The tooling elements 20 and 21 are generally tubular and conical as when the workpiece 22 is a threaded nut as seen in the drawings. The tooling elements 20 and 21 preferably include a rigidly resilient material to seal, upon closure, against an intermediate workpiece 22. It will be appreciated that the block 17 includes a post 24 which, in turn, supports the column support block 25 which is attached to machine clevis 26. A second post 24' also guides and stabilizes the floating clevis 26, as will be appreciated. The clevis 26 supports the tooling 20 and 21 in spaced-apart opposed relation while permitting reciprocation of at least one, 20, of the tooling elements 20 and 21. Compression springs 27 and 28 counterpoise the machine clevis 26. Stop ring 29 permits selected loading of the counterpoise provided on the post 24. This allows excellent repetitious registry as between parts 22 and tooling elements 20 and 21 and a controlled floatation as the tooling elements 20 and 21 close and open against workpieces 22.

A crown block 30 on the upper portion of the machine clevis 26 provides a mounting means for the reversible motor or cylinder 31 and journalling for the piston 32 thereof. The piston 32 extends vertically through the crown block 30 and is drivably connected to the upper tooling support and slide 33. The upper tooling support and slide 33 moves vertically on the ways 34 supported by the throat portion 35 of the C-shaped clevis 26. The tooling support and slide 33 is fastened to the tooling 20. This maintains constant axial registering alignment as between the upper and lower tooling 20 and 21, the tooling 21 being supported in the fixed jaw 36 of the clevis 26.

The reversible motor 37 on the tooling support element 33, the reversible motor 38 on the tooling block 39, and the reversible motor 40 mounted on the clevis throat portion 35 will be seen as functioning to selectively provide control over the internal passages in the tooling block 39 and to assist in defining the functioning chambers with adequate sealing and in support of the tooling element 20 and its nozzle, as will be seen. The motor 40 reversibly drives the arm 41 through compensating connection 42 to change the angle of delivery through the nozzle and onto the coating area. As positioned, the apparatus 11 repetitiously closes on the workpieces or parts 22 as they register between the tooling elements 20 and 21. Coating material is then injected into the cavity defined by the threads 23 and passes through to tool element 21 where surplus coating material is exhausted to atmosphere for discard or reuse. The tooling 20 and 21 selectively opens and the cycle is repeated. Periodically, when the tooling 20, 21 is opened, the motor 18 shifts the assembly on the ways 13 to the right (as shown in FIG. 1) and the system is purged with solvent and blown clear at a position removed from the line of workpieces as fastener elements (nuts 22). Then the motor 18 shoves the assembly into the relationship shown and the repetitious treatment of fastener elements (nuts) continues.

By reference to FIG. 2, the shifting of block 17 by the motor 18 is shown in phantom line in the purging or clean-up position and away from the line of nuts 22. In the FIG. 2 the nozzle 43 is seen depending axially from the tooling 20.

In FIG. 3 the functioning of the structure of apparatus 11 can be better appreciated since the passageways in the tooling support and slide 33 can be understood best.

In the FIG. 3 the motor 31 (FIG. 1) acting through the piston 32 and connected to the upper tooling support and slide 33 has closed the tooling elements 20 and 21 toward each other and against the part 22 (nut) and in sealing relationship thereagainst. The nozzle 43 extending from the tooling element 20 and rigidly resilient tooling element 20 extends into the threaded cavity formed by the internal threads 23 and further defined by the perimeter closure of the elements 20 and 21 at each end of the threaded openings 23. The tooling element 21 surrounds and seals the axial opening 44 which is reduced in size at constriction 45 and is selectively sized to provide a choke resistance or back pressure. The venting line 46 then provides an exhaust into and through a tube 47, as desired. The rigidly resilient nose cone seal 48 in the tooling 21 rests in sealed relation on the flanged tooling insert 49 and the flange 50 is in thrust relation against the compression spring 51 which bears against the fixed jaw 36 of the clevis 26. The tube 47 carries away surplus coating material and gases in a controlled venting manner admitting of re-use of surplus or residual coating materials. The spring 51 assists in cushioning the contact of the tooling elements 20 and 21 as urged by the piston 32. The tooling block 39 is comprised of stacked block elements 52, 53, 54, and 55 which together define a main connected passageway 56 and each block element 52, 53, 54, and 55 provided with ring seals 57 effective upon assembly, as shown in prevention of undesirable leakage.

Passageway 56 is operably flow connected to the nozzle 43 and the nozzle 43 is retained by and supported by the tooling element 20. In this manner the arm 41 is connected drivably to the nozzle 43 through the tooling 20 so that the nozzle 43 is rotated axially through about sixty degrees of traverse when driven by the motor 40 and the connecting linkage 42. The nozzle 43 is radially perforated in staggered rows at about forty-five degree intervals and with dimensions selected to assure satisfactory fogging, misting or atomization of the applied material and its air drive. At application of high pressure air, and until the pressure drops through the time delay choke, the movement of the nozzle 43 is achieved.

In operation, and referring to FIG. 3, a charge 62 of coating material is metered into the passage 56 by the action of the motor 38 which operates the needle 59 of needle valve 60 in block element 53. Low pressure air is then introduced to the passage 56 through valved entry 61 and this presses the charge 62 through the chamber of the passageway 56 and into the barrel or firing chamber 63 of the nozzle 43. Then, the motor 41 causes sudden opening of the needle valve 64 in the valve 65 of the block 33 communicating a blast of high pressure air to the passageway 56, thereby blasting the coating material through the openings in the nozzle 43 and atomizing the coating material into and (with delay) through the cavity formed by the part 22 and the closure of the tooling elements 20 and 21 and through the exhaust port 44, through the choke orifice 45, and thence out the vent portion 46 and tube 47 for collection of surplus. The sudden burst of eneregy achieves an excellent coating on the selected surfaces of the threads, for example, and substantially all surplus is blown clear with a following blast of air to the atmosphere or low pressure side of the system. Fine tuning is achieved by drawing a vacuum of slightly less than negative air pressure on the exhaust since. When chamber and passage pressures normalize, the tooling 20, 21 is separated and a new part 22 is presented and in substantially complete avoidance of contamination of the part 22 beyond the area for coating and the cycle is repeated.

Low pressure air, as indicated in the specific application, is at a pressure of about five pounds per square inch and less than about twenty pounds per square inch adjusted to move the charge 62 to, but not through, the constriction of nozzle 43. This chambers the charge 62 for the high pressure application of air between about eighty and ninety pounds per square inch and producing a pressure of about one hundred forty pounds per square inch at the nozzle.

As previously indicated, these are variable along with tooling changes, chamber sizes and flow characteristics of the charge and are adjusted for optimum performance with particular parts and quantities of charge related to surface area to be coated. The choke constriction 45 provides an important control of delay and back pressure in the entire system and may be varied in accord with the size of workpiece and cycling speed.

Periodically, after numerous cycles of operation, the apparatus 11 shifts the tooling 20 and 21 away from registry with the part 22 and a valved introduction of solvent through the passage 66 cleans up any resin build-up from the coating material and this is blown free, then, using a sustained blast of high pressure air through valve 65 and passages 56 and through and over the lower tooling 21.

In FIG. 4, using the part 22 (nut) as an example, it will be appreciated that charge 62 is deposited in the chamber 63 of the nozzle 43 against the constriction of the plural radial openings through the nozzle 43 and that the nozzle 43 can be turned selectively by the arm 41. The tooling 20 is seen as rigidly resilient and tapered forming a selected seal perimetrically around the threaded opening 23 on one side of and masking the portion of the balance of the workpiece 22 from exposure to coating. The tooling 21 is also tapered to close in a rigidly resilient manner against the perimeter of the other side of the threaded opening 23 of the workpiece 22 and with vent provisions 44 and 46 through the constriction 45 to communicate or exhaust the pressure of the shot and any surplus coating material.

FIG. 5 indicates the piston 70 of the turning motor 40 and indicating the relative displacement through about 60 degrees of turn for the nozzle 43 operating through the linkage 42 to the arm 41 and in compensation for relative displacement.

The coating material used for the described structure was a fluorinated resin material, tetrafluorethylene, in a suitable air drying solvent such as methyl ethyl ketone. The masking faces of the tooling elements 20 and 21 are selected from materials with good wearing and rigidly resilient good memory characteristics, such as polyurethane. The motors described herein are all double-acting air cylinders amenable to simple control and sequence adjustment in which the controls form no part of the present invention. It will be realized that solenoid and mechanical equivalents of these motors are contemplated to be within the scope of the invention functioning as described. Sensing is easily achieved by monitoring pressure and using simple limit and location controls well-known in the art. While a single apparatus unit 11 has been described, plural installations are achieved, as will be appreciated, using common or separate coordinated drive and source means. Air is supplied by line compressors and the driving air is dried.

In a field particularly seeking automatic accelerated high grade coating of female thread surfaces, the present invention was regarded as substantially impossible. Production levels of one nut per one-half second per machine unit has been achieved with acceptable sustained quality. The apparatus is simple and reliable.

Having thus described our invention and a preferred embodiment thereof, those ordinarily skilled in the art will perceive improvements, changes and modifications and such improvements, changes and modifications are intended to be included within the spirit of the invention, limited only by the scope of our hereinafter appended claims.

We claim:

1. In a machine for selectively locating and applying a coating to female threads on fasteners in avoidance of the coating material contaminating the balance of the threaded part, the combination comprising:

a main passage defined through a tooling head;

a perforate nozzle connected at one end of said main passage;

a first tapered rigidly resilient ring seal surrounding said nozzle;

a second and lower rigidly resilient ring seal in spaced-apart aligned relation with said first ring seal;

means for closing and opening said ring seals toward registering axial contact with each other for impinging upon an intermediate fastener axially aligned between said ring seals, said fastener presenting a threaded female opening therethrough and into which said nozzle is thrust;

a metering valve for admitting a charge of coating material under relative low air pressure into said main passage upstream of said nozzle;

a high pressure valve located above said metering valve and selectively opening to blast said charge through said nozzle with high pressure air into the sealed cavity defined by said threaded part of said fasteners and the closure of said seals on said fastener and said cavity thus formed having a communicating passage through which said high pressure air and surplus coating material are dissipated to ambient conditions at a selected rate.

2. A device for coating female threads in fastener elements and the like comprising:

a pair of movable tapered ring seals in spaced-apart aligned axial registry, one of said seals surrounding a vent to ambient atmosphere and the other of said seals surrounding a depending diffusion nozzle and a nozzle connecting passage, said seals adapted to seat against a fastener element having a threaded opening therethrough intermediate said seals and into which threaded opening said diffusion nozzle extends;

means for introducing a metered charge of coating material at said nozzle;

high pressure gas delivery means behind said metered charge to drive said coating material through said nozzle and through said threaded opening defined by said seals; and a constriction in said vent to ambient atmosphere providing means to controllably exhaust high pressure gas and coating material to the atmosphere.

3. In the device of claim 2 further means for repetitively positioning fastener elements between said seals for coating.

4. In the device of claim 2, further means for periodically subjecting; said nozzle and said seals to entry of a coating material solvent and air blast and means shifting said seals and said nozzle clear of closure against said fastener for such periodic solvent treatment.

5. In the device of claim 2, further means for repetitively presenting; said fasteners in a line transverse to the axis of said seals and nozzle in consecutive alignment of said threaded openings with said seals and nozzle.

6. An apparatus for coating a portion of a part while preventing the coating material from reaching other portions of said part;

a machine base having ways;

a reciprocating tool mounting head movable in said base on said ways;

motor means operably secured to said machine base and to said tool mounting head for shifting said mounting head in and out of registry with said part;

a tooling set secured to said tool mounting head in gapped spaced-apart aligned relation, said tool set including a tool element in fixed relation and a tool element in axially aligned movement relation in respect to said fixed tool element;

reversible motor means secured to said tool mounting head and operably connected to the movable of said tool elements for closing and opening said movable tool element toward and away from said fixed tool element;

a main passage in said movable of said tool elements and in flow communication with a projecting nozzle axially extending from the movable of said tool elements, said main passage having controlled entries for selected positioned delivery of coating material and for high and low pressure air and solvent;

a rigidly resilient seal element projecting outwardly and axially from said movable of said tool elements and defining an upper mask enclosure around said nozzle;

means for consecutively presenting workpieces between said movable and said fixed tool elements to engage said workpieces selectively by said seal elements, thereby presenting a specific enclosed area of said workpiece to access by said nozzle;

an axially projecting rigidly resilient seal element on said fixed tool element defining an axial opening therethrough upon engagement with each of said workpieces and said opening providing communication to said nozzle, said opening through said fixed tool element having a selected reduction in cross sectional area and vented to atmosphere remotely from said workpiece; and means turning said nozzle on its principal axis when high pressure gas is released to said main passage.

7. The apparatus of claim 6 further comprising a valved passage to said main passage to selectively introduce solvent to said main passage and through said nozzle when said first-mentioned motor means moves said tool mounting head out of registry with said part and a high pressure valved source of air for purging and sweeping said main passage and flushing out said solvent.

* * * * *